US006883676B2

(12) United States Patent
Lin

(10) Patent No.: US 6,883,676 B2
(45) Date of Patent: Apr. 26, 2005

(54) GARBAGE STORAGE DEVICE

(76) Inventor: Tsong-Yow Lin, No. 57-1, Yung Ho Street, Yung Ho Village, Ta Tu Hsiang, Taichung Hsien (TW)

( * ) Notice: Subject to any disclaimer, the term of this patent is extended or adjusted under 35 U.S.C. 154(b) by 83 days.

(21) Appl. No.: 10/206,703

(22) Filed: Jul. 26, 2002

(65) Prior Publication Data

US 2004/0016756 A1 Jan. 29, 2004

(51) Int. Cl.[7] ..... B65D 43/26
(52) U.S. Cl. ..... 220/263; 220/908; 4/246.3
(58) Field of Search ..... 220/262–264, 220/908, 828, 825, 826; 4/246.3, 248; 16/63, 66, 70, 84, 57

(56) References Cited

U.S. PATENT DOCUMENTS

| | | | | |
|---|---|---|---|---|
| 966,145 A | | 8/1910 | Wilder | |
| 1,012,346 A | | 12/1911 | Fraser | |
| 1,237,016 A | | 8/1917 | Brown | |
| 1,265,148 A | | 5/1918 | Warren | |
| 1,379,677 A | | 5/1921 | Brunhoff | |
| 1,461,253 A | | 7/1923 | Owen | |
| 1,489,447 A | | 4/1924 | Leeb | 312/23 |
| 1,507,040 A | * | 9/1924 | Zifferer | 220/263 |
| 1,515,989 A | | 11/1924 | Banes | 220/264 X |
| 1,615,879 A | | 2/1927 | Leppert | 220/263 |
| 1,639,992 A | | 8/1927 | Geibel | 220/263 |
| 1,703,509 A | | 2/1929 | Chandlee | |
| 1,714,332 A | | 5/1929 | Ullrich | 220/263 |
| 1,799,621 A | | 4/1931 | Shaw | |
| 1,820,555 A | | 8/1931 | Buschman | |
| 1,881,120 A | | 10/1932 | Fessler et al. | |
| 1,891,651 A | | 12/1932 | Padelford et al. | |
| 1,966,323 A | * | 7/1934 | Von Elm | 220/263 |
| 2,016,558 A | | 10/1935 | Redrup | |
| D102,512 S | | 12/1936 | Stallings et al. | |
| 2,071,486 A | | 2/1937 | Wright | 220/263 |
| 2,096,578 A | | 10/1937 | Flanagan | |
| 2,106,892 A | | 2/1938 | Meyer | 220/263 |
| D108,642 S | | 3/1938 | Geisel | |
| 2,170,604 A | | 8/1939 | Creesy et al. | |
| D118,374 S | | 1/1940 | Kamenstein | |
| 2,195,033 A | | 3/1940 | Lehman | |
| D120,270 S | | 4/1940 | Martinez | |
| 2,216,279 A | | 10/1940 | Packer | |
| 2,242,698 A | | 5/1941 | Evitt | |
| 2,246,975 A | | 6/1941 | Geibel | 220/264 X |
| 2,255,972 A | | 9/1941 | Harvard | |
| 2,308,398 A | | 1/1943 | Stevens | |
| 2,311,835 A | | 2/1943 | Johnson | |

(Continued)

FOREIGN PATENT DOCUMENTS

| | | | | |
|---|---|---|---|---|
| DE | 4132958 | * | 5/1992 | 220/262 |
| DE | 20001431 | * | 6/2000 | 220/262 |
| JP | 2000008700 A | | 1/2000 | E05F/5/08 |
| TW | 322904 | | 12/1997 | |

*Primary Examiner*—Lien Ngo
(74) *Attorney, Agent, or Firm*—Alan D. Kamrath; Nikolai & Mersereau, P.A.

(57) ABSTRACT

A garbage storage device includes a base, a bin installed on the base, a pedal mounted on the bin, a lid mounted on the bin, a linkage arranged between the pedal and the lid and a buffer arranged between the base and the linkage. The buffer includes a first cylinder including a closed end connected with the base and an open end through which a spring is inserted and a second cylinder including an open end through which the spring is inserted and a closed end connected with the linkage. The first cylinder is partially inserted in the second cylinder. The first cylinder includes an ear formed at the closed end and mounted on ears of the base. The second cylinder includes a tube transversely extending from the closed end for receiving the first end of the second lever.

16 Claims, 8 Drawing Sheets

U.S. PATENT DOCUMENTS 2,325,897 A 8/1943 Waltman ..... 220/264
D145,970 S 11/1946 Bloomfield
D147,646 S 10/1947 Footlik
D151,986 S 12/1948 Hamilton
2,475,125 A 7/1949 Brownell
2,547,089 A 4/1951 Oberst ..... 16/66
2,563,456 A 8/1951 Brownell
2,904,210 A 9/1959 Grossman
2,907,491 A 10/1959 Gunn
2,910,206 A 10/1959 Hodgson
2,920,338 A * 1/1960 Falk ..... 16/66
D187,300 S 2/1960 Tupper
D187,305 S 2/1960 Leominster
2,946,474 A 7/1960 Knapp ..... 220/23.87
D191,546 S 10/1961 Garner
D197,007 S 12/1963 Bringhton
3,450,297 A 6/1969 Clerk
3,689,103 A * 9/1972 Meulendyk ..... 280/5.513
3,866,791 A 2/1975 Roper et al.
D241,499 S 9/1976 Raftery
4,081,105 A 3/1978 Dagonnet et al. ..... 220/263
D256,423 S 8/1980 Bacskay et al.
D261,720 S 11/1981 Brazis
4,361,247 A * 11/1982 Williams ..... 220/88.1
4,363,417 A 12/1982 Rhoades et al.
4,445,619 A 5/1984 Kubic et al.
4,473,170 A 9/1984 Ciancimino
4,489,810 A 12/1984 Curtis
4,629,167 A 12/1986 Kimura et al. ..... 267/226
4,785,964 A 11/1988 Miller et al. ..... 220/263
4,877,226 A * 10/1989 Taylor ..... 267/196
4,913,308 A 4/1990 Culbertson ..... 220/263
4,953,744 A 9/1990 Koyama
D312,160 S 11/1990 Calvi
D319,905 S 9/1991 Hotchkiss
D321,575 S 11/1991 Corps
D322,350 S 12/1991 Craft, Jr. et al.
5,082,139 A 1/1992 Quam
D327,965 S 7/1992 Chelee
D328,510 S 8/1992 Brussing
D329,929 S 9/1992 Knoedler et al.
5,142,738 A 9/1992 Ojima ..... 16/306
5,163,574 A 11/1992 Susan ..... 220/263
5,170,904 A 12/1992 Neuhaus ..... 220/263
D332,334 S 1/1993 Jones
D332,852 S 1/1993 Delmerico
D333,024 S 2/1993 Van Buiten
D333,025 S 2/1993 Doherty
D333,897 S 3/1993 Ward
D335,561 S 5/1993 Mihyar
D335,562 S 5/1993 Evans
5,211,269 A 5/1993 Ohshima ..... 188/290
5,230,525 A 7/1993 Delmerico et al. ..... 220/263
5,237,708 A 8/1993 Zamoyski ..... 4/246.3
5,249,693 A 10/1993 Gillispie et al. ..... 220/263
5,269,087 A * 12/1993 Johnston ..... 43/4
D343,486 S 1/1994 Kimport
5,295,607 A 3/1994 Chang ..... 220/263
5,350,079 A 9/1994 Larson et al.
5,356,025 A 10/1994 Renault
D352,144 S 11/1994 Brookshire et al.
D355,060 S 1/1995 Bernstein et al.
5,382,108 A 1/1995 Ojima ..... 403/120
5,440,978 A 8/1995 O'Brien et al. ..... 220/264 X
5,474,201 A * 12/1995 Liu ..... 220/23.87
D368,563 S 4/1996 Brightbill et al.
5,531,348 A 7/1996 Baker et al. ..... 220/263
D377,554 S 1/1997 Adriaansen
D381,784 S 7/1997 Keller et al.
D393,334 S 4/1998 Presnell et al.
D401,028 S 11/1998 Ahern, Jr. et al.
5,842,595 A 12/1998 Williams
5,960,983 A 10/1999 Chan
D418,957 S 1/2000 Rashid
6,010,024 A 1/2000 Wang ..... 220/23.87
6,024,238 A * 2/2000 Jaros ..... 220/264
D431,700 S 10/2000 Roudebush
D431,702 S 10/2000 McKeown et al.
D435,951 S 1/2001 Yang et al.
6,178,085 B1 1/2001 Leung ..... 361/683
D439,717 S 3/2001 Konieczny
6,206,281 B1 3/2001 Leung ..... 235/61 R
D441,160 S 4/2001 Lin
D442,330 S 5/2001 Cousins
D446,375 S 8/2001 Daams
D447,304 S 8/2001 Niemeyer
D447,308 S 8/2001 Lin
D447,611 S 9/2001 Lin
D450,901 S 11/2001 Lin
D453,252 S 1/2002 Lin
D453,253 S 1/2002 Lin
6,336,252 B1 1/2002 Bando ..... 16/307
D453,600 S 2/2002 Lin
D453,870 S 2/2002 Lin
6,345,725 B1 2/2002 Lin ..... 220/263
D454,239 S 3/2002 Lin
D460,595 S 7/2002 Lin
D465,629 S 11/2002 Lin
D465,630 S 11/2002 Lin
D465,893 S 11/2002 Lin
D465,894 S 11/2002 Lin
D466,265 S 11/2002 Lin
D466,667 S 12/2002 Lin
D467,696 S 12/2002 Rashid
D468,500 S 1/2003 Lin
6,510,588 B2 1/2003 Eromaki ..... 16/308
D470,639 S 2/2003 Quan
D472,686 S 4/2003 Lin
D472,687 S 4/2003 Lin
D472,688 S 4/2003 Lin
D476,126 S 6/2003 Lin
D476,128 S 6/2003 Lin
D476,458 S 6/2003 Lin
D476,460 S 6/2003 Lin
D476,788 S 7/2003 Lin
2002/0079315 A1 * 6/2002 Yang
2002/0092853 A1 * 7/2002 Wang
2003/0173369 A1 9/2003 Nikolaus et al. ..... 220/830
2003/0201265 A1 10/2003 Lin ..... 220/254.3
2003/0201267 A1 * 10/2003 Yang et al.
2003/0201268 A1 10/2003 Lin ..... 220/263
2004/0016756 A1 1/2004 Lin ..... 220/263

* cited by examiner

GARBAGE STORAGE DEVICE

BACKGROUND OF INVENTION

1. Field of Invention

The present invention relates to a garbage storage device including a lid and a buffer for the lid.

2. Related Prior Art

People dispose of garbage in garbage bins. Some of the garbage stinks some time after the disposal. Therefore, some of the garbage bins are equipped with lids in order to keep the odor of such garbage therein. In some other cases, people use garbage bins equipped with lids simply to conceal garbage contained therein.

Some lids can be removed from garbage bins. However, such a lid causes a user trouble for he or she has to hold the lid during disposal of garbage or find a place on which to lay the lid before disposal of garbage.

A conventional garbage storage device includes a base, a bin installed on the base, a pedal pivotally mounted on the bin and a lid pivotally mounted on the bin. A linkage is arranged between the pedal and the lid. The linkage includes a first lever and a second lever. The first lever is pivotally mounted on the base. The first lever includes a first end in contact with the pedal and a second end. The second lever includes a first end connected with the second end of the first lever and a second end connected with the lid. Specifically, the second end of the first lever defines an aperture for receiving the first end of the second lever. Thus, the pedal can be stepped on in order to lift the lid through the linkage. However, closing the bin with the lid often makes a loud noise.

The present invention is therefore intended to obviate or at least alleviate the problems encountered in the prior art.

SUMMARY OF INVENTION

It is the primary objective of the present invention to provide a garbage storage device that makes little noise when moved from an open position to a closed position.

According to the present invention, a garbage storage device includes a base, a bin installed on the base, a pedal pivotally mounted on the bin, a lid pivotally mounted on the bin, a linkage arranged between the pedal and the lid and a buffer arranged between the base and the linkage.

The buffer may include a spring connected between the base and the linkage. The buffer may further include a first cylinder including a closed end connected with the base and an open end through which the spring is inserted and a second cylinder including an open end through which the spring is inserted and a closed end connected with the linkage.

One of the first and second cylinders may be partially inserted in the other one of the first and second cylinders. The first cylinder may be partially inserted in the second cylinder. The buffer may include a ring mounted on the first cylinder. The buffer may include a groove defined around one of the first cylinder for receiving the ring.

The base may include two ears formed thereon. The first cylinder may include an ear formed at the closed end and mounted on the ears of the base. Each of the ears of the base may include a boss formed thereon facing that of the other one of the ears of the base, and the ear of the first cylinder defines two recesses for receiving the bosses of the ears of the base.

The second cylinder may include a tube transversely extending from the closed end for receiving the first end of the second lever.

Other objectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
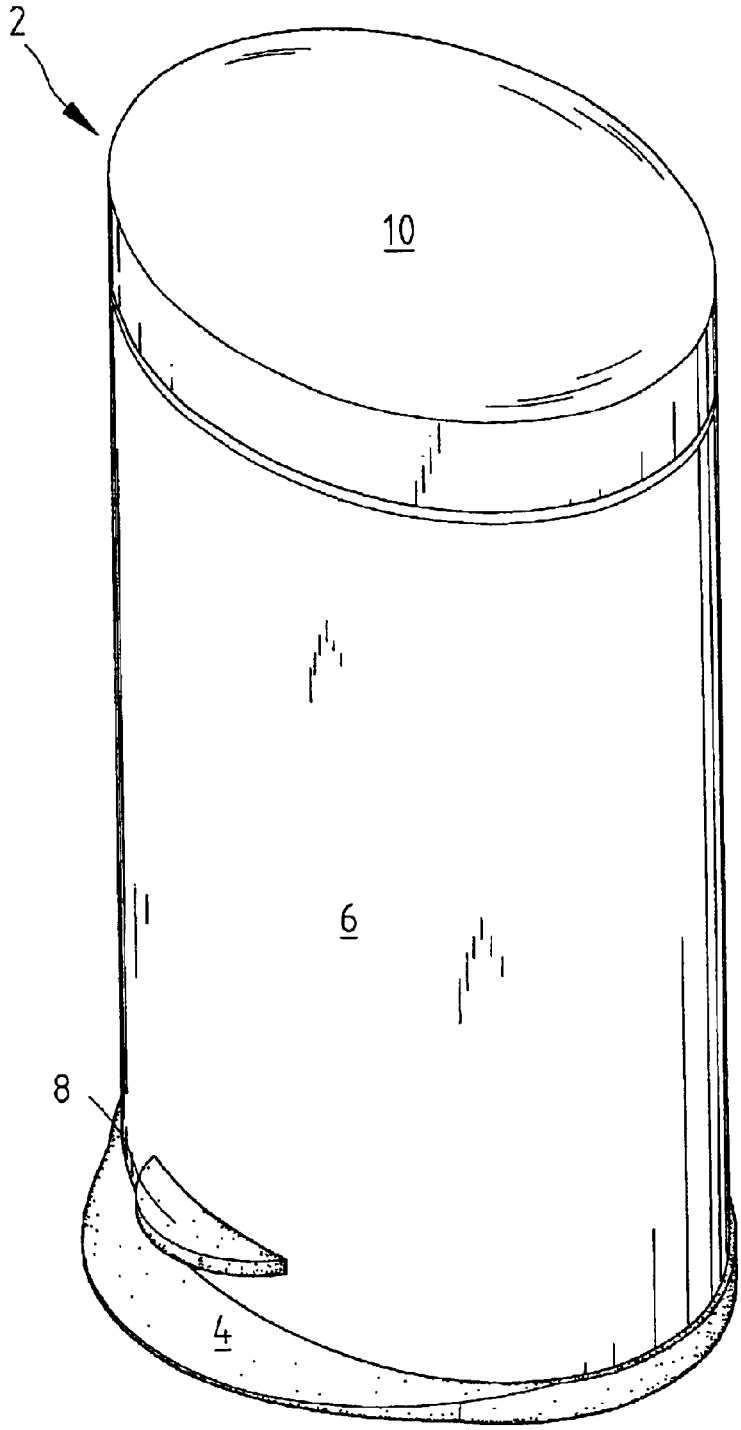
FIG. 1 is a perspective view of a garbage storage device including a bin and a lid.

Referring to FIG. 1, a garbage storage device 2 includes a base 4, a bin 6 installed on the base 4, a pedal 8 pivotally mounted on the bin 6 and a lid 10 pivotally mounted on the bin 6.

Figure 2:
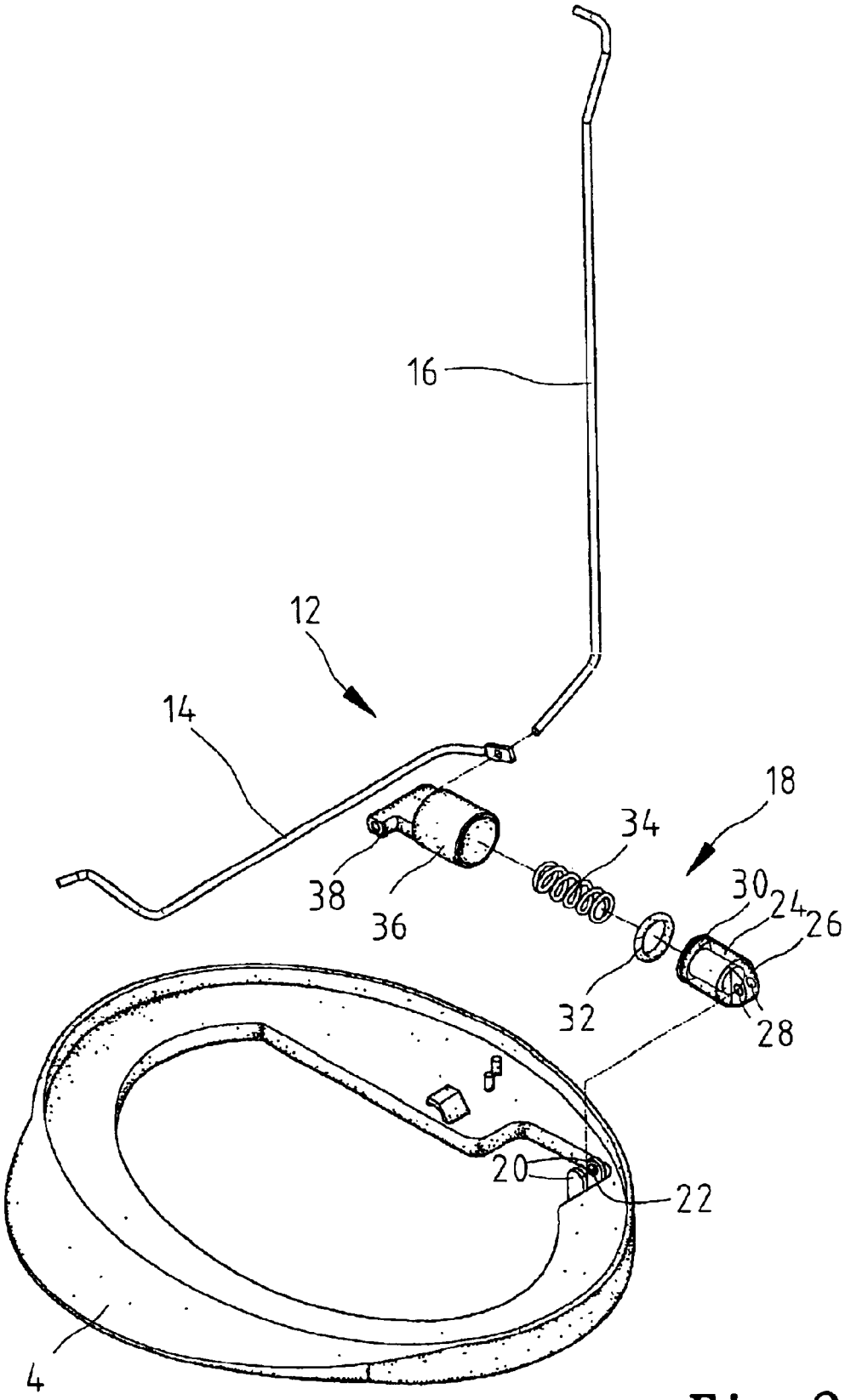
FIG. 2 is an exploded view of a buffer according to the present invention for the lid of the garbage storage device shown in FIG. 1.

FIG. 2 shows a linkage 12 arranged between the pedal 8 and the lid 10 of the garbage storage device shown in FIG. 1. The linkage 12 includes a first lever 14 and a second lever 16. The first lever 14 is pivotally mounted on the base 4. The first lever 14 includes a first end in contact with the pedal 8 and a second end. The second lever 16 includes a first end connected with the second end of the first lever 14 and a second end connected with the lid 10. Specifically, the second end of the first lever 14 defines an aperture for receiving the first end of the second lever 16. Thus, the pedal 8 can be stepped on in order to lift the lid 10 through the linkage 12.

FIG. 2 further shows a buffer 18 according to the preferred embodiment of the present invention for use in the garbage storage device 2 shown in FIG. 1. The buffer 18 is arranged between the base 4 and the linkage 12.

For pivotal connection with the buffer 18, the base 4 includes two ears 20 each formed with a boss 22 facing that of the other ear 20.

The buffer 18 includes a first cylinder 24 including a closed end and an open end. The first cylinder 24 is formed with an ear 26 at the closed end. The ear 26 defines two recesses 28 on opposite sides. The ear 26 is inserted between the ears 20 so that the bosses 22 are received in the recesses 28. Thus, the first cylinder 24 is pivotally mounted on the ears 20. A groove 30 is defined around the first cylinder 24 near the open end. A ring 32 is received in the groove 30.

The buffer 18 further includes a spring 34 received in the first cylinder 24.

The buffer 18 further includes a second cylinder 36 with an open end and a closed end. The second cylinder 36 includes a tube 38 transversely extending from the closed end. The second cylinder 36 is mounted on the first cylinder 24. The first end of the second lever 16 is inserted in the tube 38. Thus, the second cylinder 36 is pivotally connected with the second lever 16.

Figure 3:
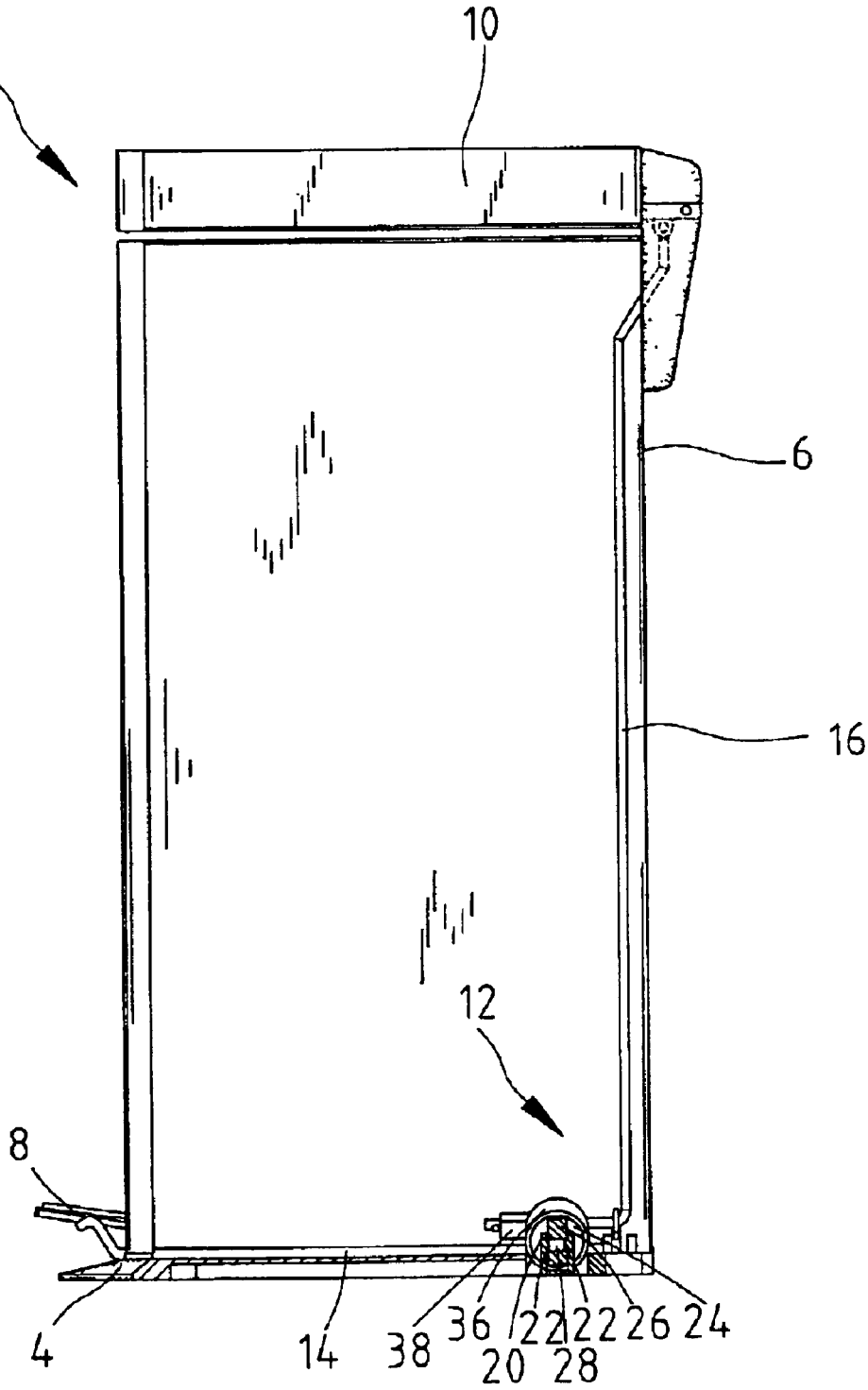
FIG. 3 is a cross-sectional view of the garbage storage device shown in FIG. 1 equipped with the buffer shown in FIG. 2.
Figure 4:
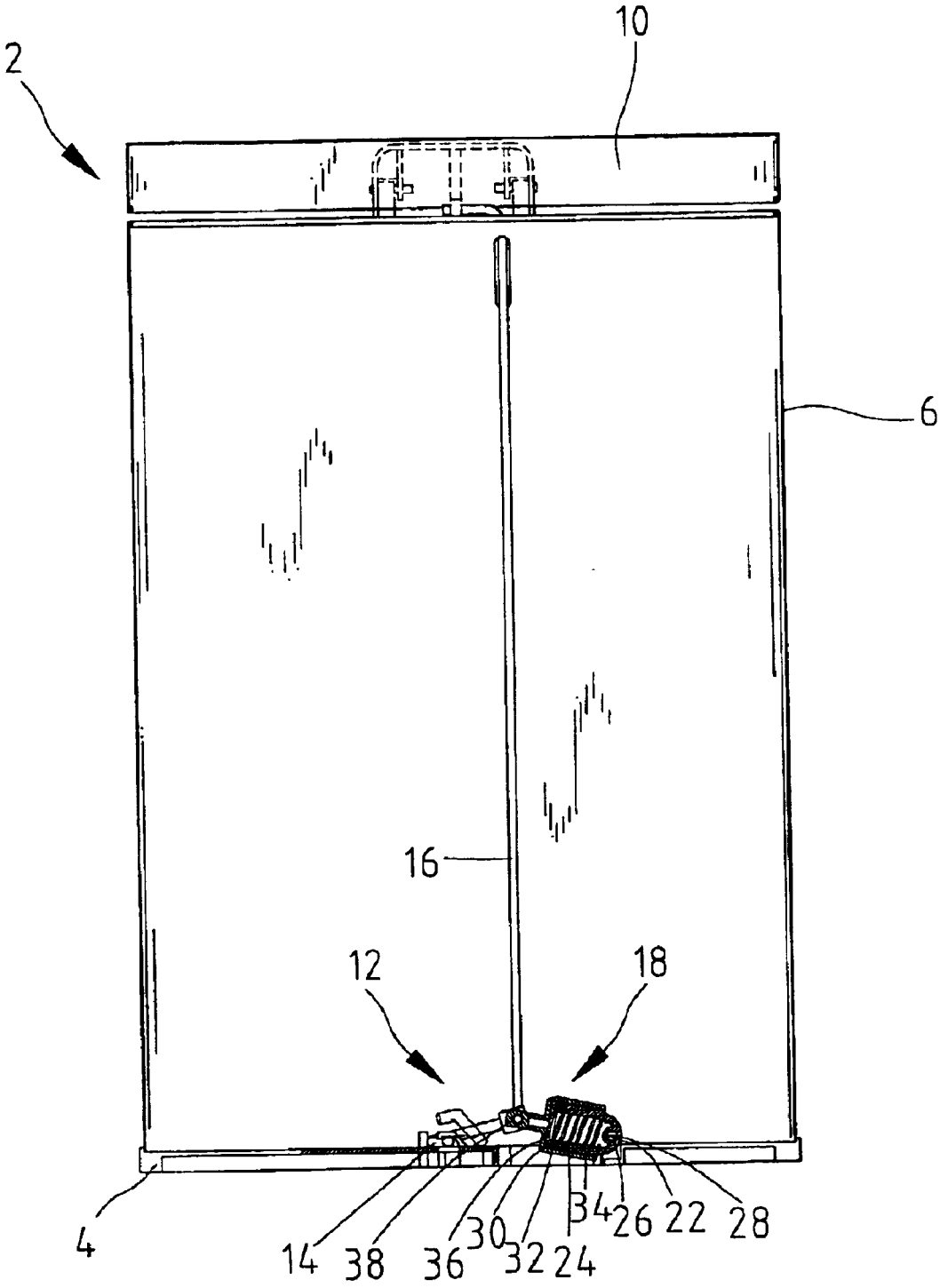
FIG. 4 is a cross-sectional view taken along a line 4—4 in FIG. 3.

FIGS. 3 and 4 show the garbage storage device 2 in a closed position where the buffer 18 telescopes to a retracted condition, and the spring 34 is compressed.

Figure 5:
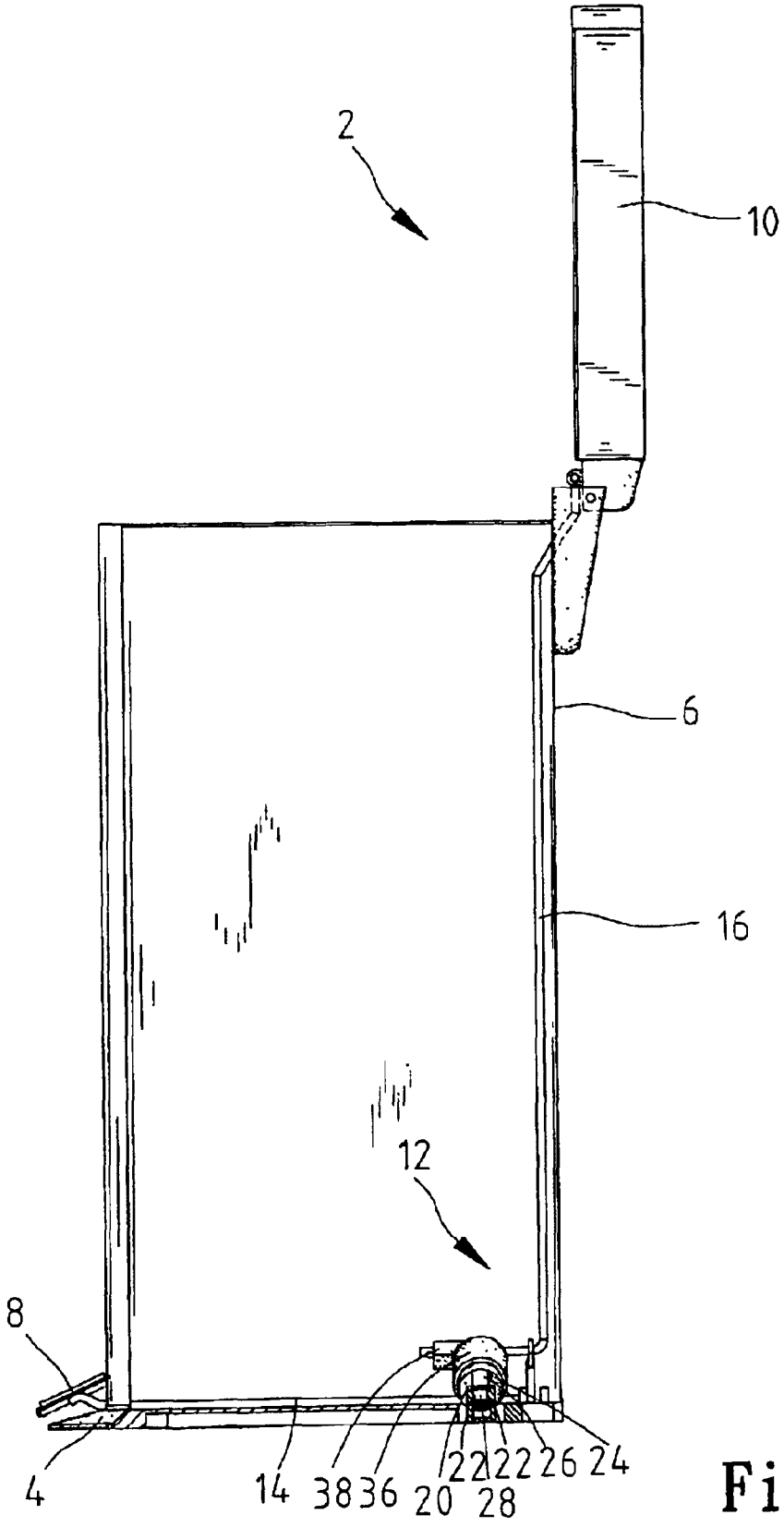
FIG. 5 is identical to FIG. 3 except for showing the garbage storage device in a fully open position.
Figure 6:
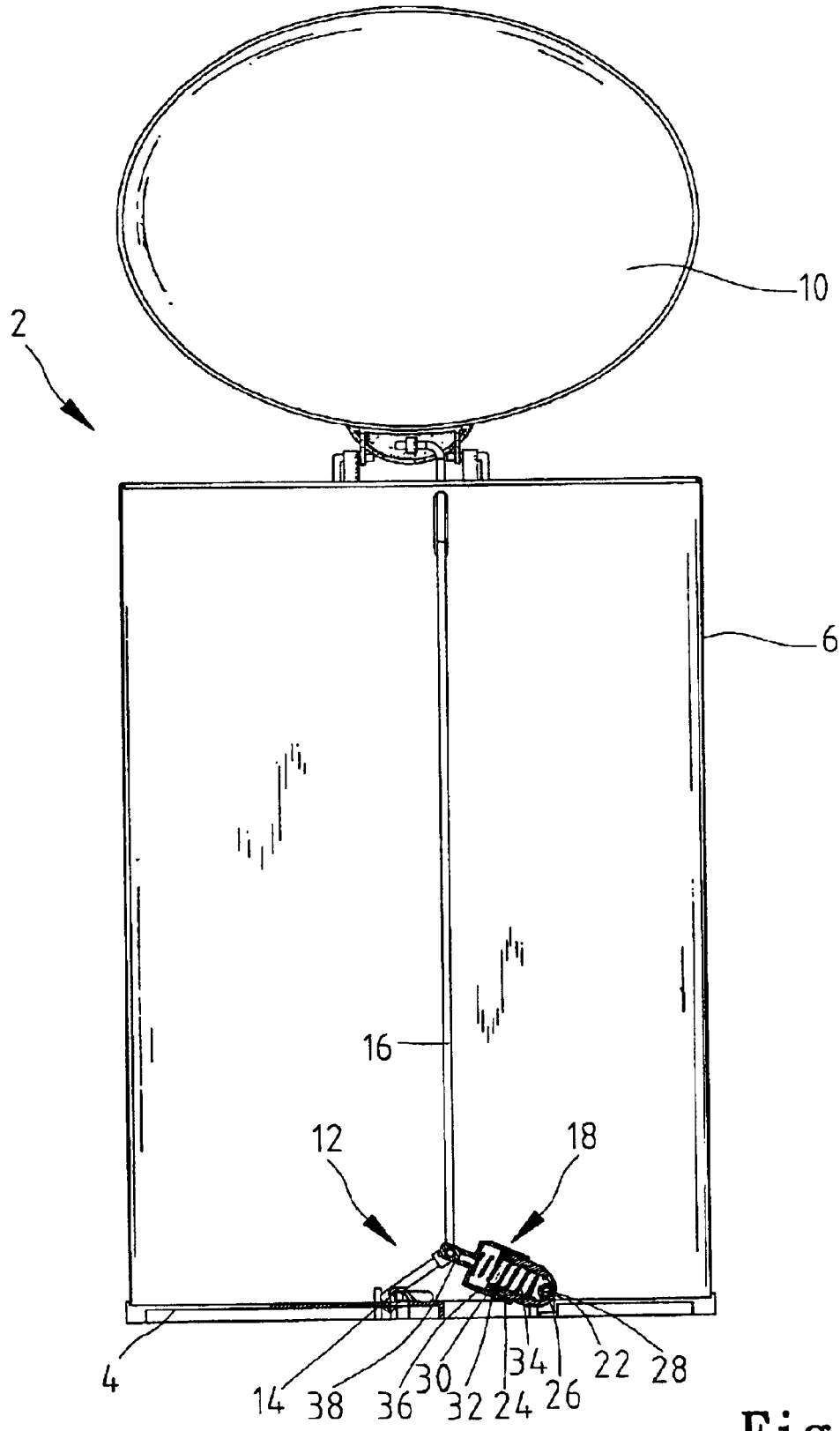
FIG. 6 is a cross-sectional view taken along a line 6—6 in FIG. 5.

Referring to FIGS. 5 and 6, the lid 10 is pivotally moved until the garbage storage device 2 reaches a fully open position. The buffer 18 fully extends and the spring 34 is not compressed.

Figure 7:
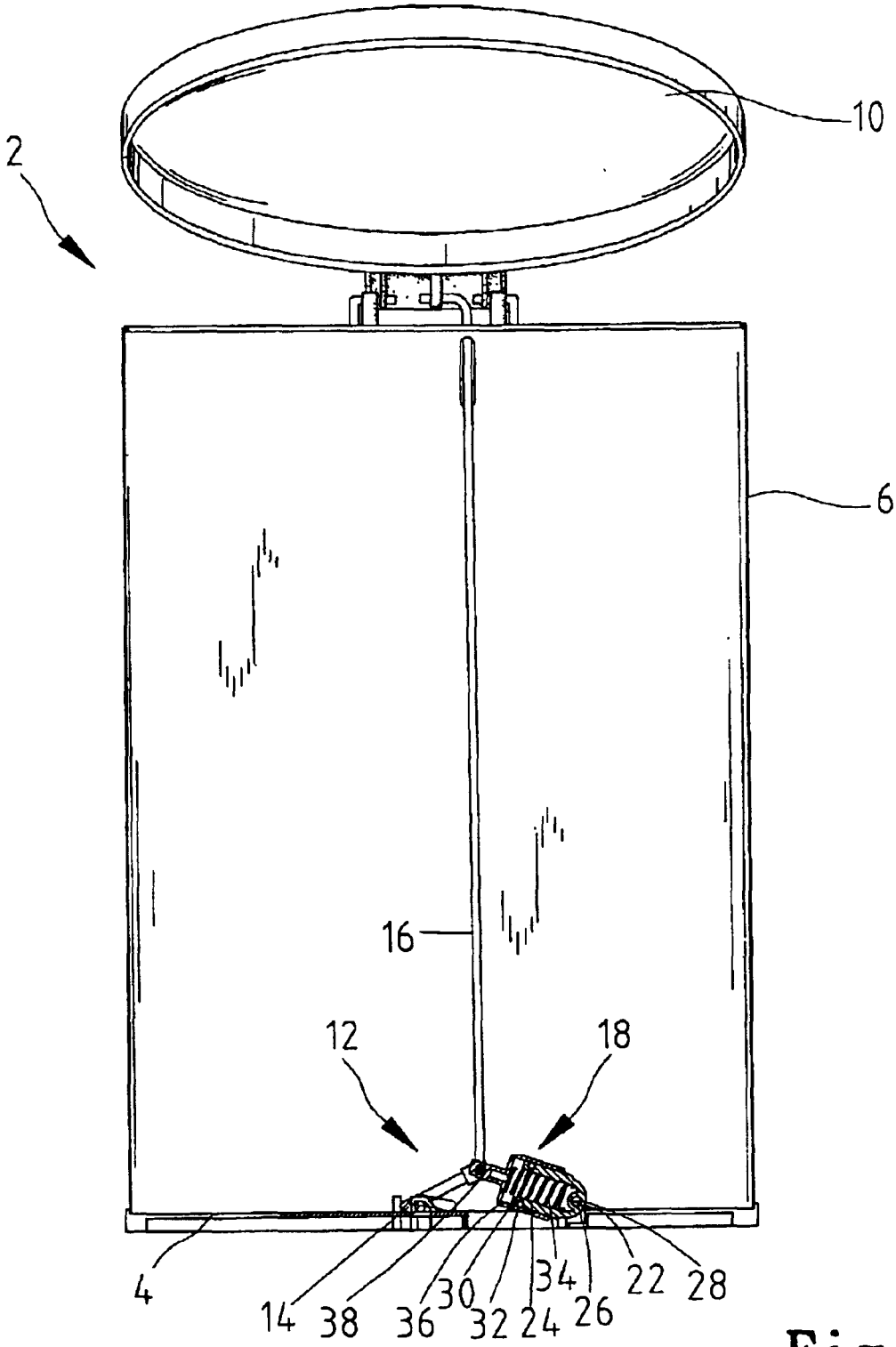
FIG. 7 is identical to FIG. 6 except for showing the garbage storage device in a different position.

Referring to FIG. 7, the lid 10 is released, and the lid 10 falls due to its weight. The movement of the lid 10 is buffered or hindered via the buffer 18 since they are both connected with the linkage 12.

Figure 8:
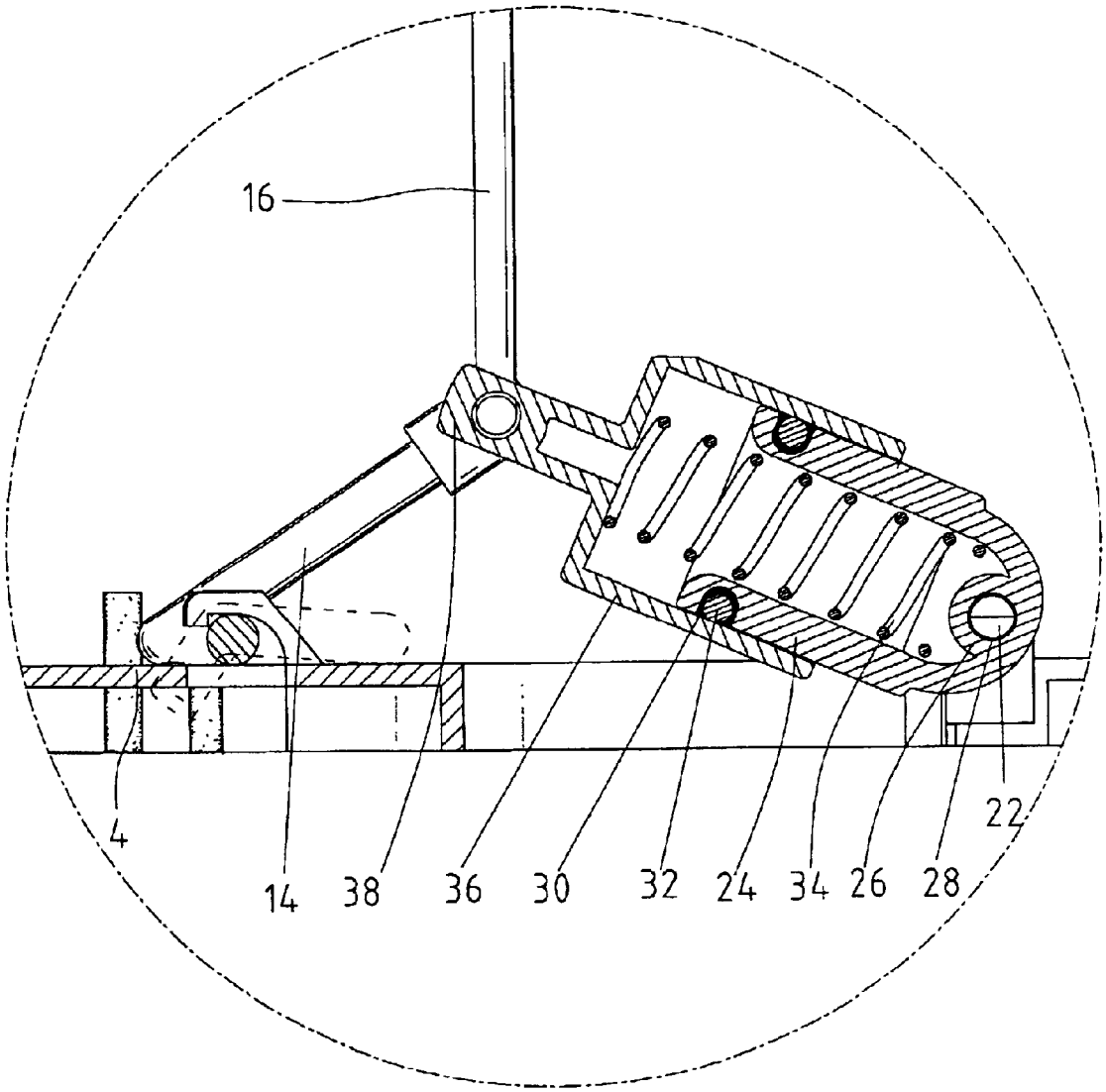
FIG. 8 is an enlarged cross-sectional view of the buffer shown in FIG. 7.

Referring to FIG. 8, damping oil can be used in a gap defined between the first cylinder 24 and the second cylinder 36 in order to enhance the buffering of the movement on the falling lid 10.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. A garbage storage device including a base, a bin installed on the base, a pedal mounted on the bin, a lid mounted on the bin, a linkage arranged between the pedal and the lid, with the linkage including a first lever having a first end for manual engagement and a second end, a second lever including a first end connected with the second end of the first lever and a second end connected with the lid, with the first lever being pivotally mounted relative to the bin about a first axis extending in a direction including the first and second ends of the first lever, with the first end of the second lever being pivotally connected with the second end of the first lever about a second axis parallel to but spaced from the first axis; and a buffer arranged between the base and the linkage wherein the buffer includes a spring connected between the base and the linkage, and wherein the buffer includes a first cylinder including a closed end connected with the base and an open end through which the spring is inserted and a second cylinder including an open end through which the spring is inserted and a closed end connected with the linkage with the first cylinder being movable relative to the second cylinder, with the spring being sandwiched between the closed ends of the first and second cylinders, wherein one closed end connected to the base and the other closed end connected to the first end of the second lever at the connection with the first lever.

2. The garbage storage device according to claim 1 wherein one of the first and second cylinders is partially inserted in the other one of the first and second cylinders.

3. The garbage storage device according to claim 2 wherein the first cylinder is partially inserted in the second cylinder.

4. The garbage storage device according to claim 3 wherein the buffer includes an O-ring mounted on the first cylinder and slideably received in the second cylinder, with the O-ring sliding in the second cylinder when the spring is being compressed between the closed ends of the first and second cylinders.

5. The garbage storage device according to claim 4 wherein the buffer includes a groove around the first cylinder for receiving the ring.

6. The garbage storage device according to claim 1 wherein the base includes two ears formed thereon, and the first cylinder includes an ear formed at the closed end and mounted on the ears of the base.

7. The garbage storage device according to claim 6 wherein each of the ears of the base includes a boss formed thereon facing that of the other one of the ears of the base, and the ear of the first cylinder defines two recesses for receiving the bosses of the ears of the base.

8. The garbage storage device according to claim 1 wherein the second cylinder includes a tube transversely extending from the closed end for receiving the first end of the second lever.

9. A garbage storage device including:

a base;

a bin installed on the base;

a pedal mounted on the bin;

a lid mounted on the bin;

a linkage including a first lever including a first end in contact with the pedal and a second end and a second lever including a first end connected with the second end of the first lever and a second end connected with the lid; and a buffer connected between the base and one of the first and second levers, wherein the buffer includes a spring connected between the base and one of the first and second levers, and wherein the buffer includes a first cylinder including a closed end connected with the base and an open end through which the spring is inserted and a second cylinder including an open end through which the spring is inserted and a closed end connected with one of the first and second levers, with the first cylinder being movable relative to the second cylinder, with the spring being sandwiched between the closed ends of the first and second cylinders wherein one closed end connected to the base and the other closed end connected to the first end of the second lever at the connection with the first lever.

10. The garbage storage device according to claim 9 wherein one of the first and second cylinders is partially inserted in the other one of the first and second cylinders.

11. The garbage storage device according to claim 10 wherein the first cylinder is partially inserted in the second cylinder.

12. The garbage storage device according to claim 11 wherein the buffer includes an O-ring mounted on the first cylinder and slideably received in the second cylinder, with the O-ring sliding in the second cylinder when the spring is being compressed between the closed ends of the first and second cylinders.

13. The garbage storage device according to claim 12 wherein the buffer includes a groove around the first cylinder for receiving the ring.

14. The garbage storage device according to claim 9 wherein the base includes two ears formed thereon, and the first cylinder includes an ear formed at the closed end and mounted on the ears of the base.

15. The garbage storage device according to claim 14 wherein each of the ears of the base includes a boss formed thereon facing that of the other one of the ears of the base, and the ear of the first cylinder defines two recesses for receiving the bosses of the ears of the base.

16. The garbage storage device according to claim 9 wherein the second cylinder includes a tube transversely extending from the closed end for receiving the first end of the second lever.

* * * * *